US006600141B1

(12) United States Patent
Danko et al.

(10) Patent No.: US 6,600,141 B1
(45) Date of Patent: Jul. 29, 2003

(54) THERMOSTAT ASSEMBLY FOR A HEATER

(75) Inventors: Michael Danko, Cookeville, TN (US); Jimmy L. Sherrill, Cookeville, TN (US); Ike D. Walker, Monterey, TN (US)

(73) Assignee: Tutco, Inc., Cookeville, TN (US)

( * ) Notice: Subject to any disclaimer, the term of this patent is extended or adjusted under 35 U.S.C. 154(b) by 0 days.

(21) Appl. No.: 10/120,509

(22) Filed: Apr. 12, 2002

(51) Int. Cl.[7] ..... F04B 39/10; F04B 53/10

(52) U.S. Cl. ..... 219/532; 219/536

(58) Field of Search ..... 219/532, 536, 219/465.1, 201, 370, 364; 174/138 J; 337/403, 67; 392/376

(56) References Cited

U.S. PATENT DOCUMENTS 3,770,939 A * 11/1973 Kokjohn ..... 219/532
3,964,004 A * 6/1976 Mertler ..... 337/67
4,110,600 A * 8/1978 Spotts et al. ..... 219/364
4,289,955 A * 9/1981 Seeley ..... 219/532
4,398,082 A * 8/1983 Johannsen ..... 219/370
5,204,509 A * 4/1993 Etters et al. ..... 219/201
5,437,001 A * 7/1995 Chaney et al. ..... 392/376
5,568,586 A * 10/1996 Junkel ..... 392/376
5,641,420 A * 6/1997 Peterson et al. ..... 219/536
5,734,312 A * 3/1998 Czerner et al. ..... 337/403
5,935,471 A * 8/1999 St. Louis ..... 219/465.1
6,222,133 B1 * 4/2001 St. Louis ..... 174/138 J
6,433,318 B2 * 8/2002 Danko ..... 219/536

* cited by examiner

*Primary Examiner*—Teresa Walberg
*Assistant Examiner*—Leonid Fastovsky
(74) *Attorney, Agent, or Firm*—Clark & Brody

(57) ABSTRACT

A heater assembly includes a mounting assembly, a conducting structure, a thermostat structure, a first terminal structure and a second terminal structure, and an insulator support structure including a terminal receiving opening formed therethrough. The conducting structure and the insulator support structure are releasably and fixedly secured to the mounting assembly. The terminal receiving opening of the insulator support structure cooperates with the first terminal structure to secure the first terminal structure to the mounting assembly. The second terminal structure is releasably and fixedly secured to the mounting assembly. The thermostat structure is connected to the first terminal structure and to the second terminal structure. The first terminal structure is then connected to a power delivering structure to receive power to be used by the heater assembly, and to deliver power, through the thermostat structure, to the conducting structure. The second terminal structure is also coupled to the conducting structure.

62 Claims, 4 Drawing Sheets

THERMOSTAT ASSEMBLY FOR A HEATER

FIELD OF THE INVENTION

The present invention relates in general to heater assemblies. In particular, the present invention relates to a heater with an improved thermostat assembly.

BACKGROUND OF THE INVENTION

It is known to support an in-line thermostat, used for controlling an open coil electric heater, to a heater assembly by supporting each of the two terminal structures of the in-line thermostat with a ceramic insulator connected to a support bar of a heater frame (see, for example, U.S. Pat. No. 3,770,939). As such, known heater assemblies are not configured to (directly) connect a terminal structure of an in-line thermostat to a terminal supplying power to a heater assembly. In addition, such heater assemblies are not configured to attach, through a ceramic insulator(s), a terminal structure of an in-line thermostat to a (sheet metal) support plate of a heater assembly. Certain heating element designs, however, require a terminal structure of an in-line thermostat to be (directly) connected to a terminal supplying power to a heater assembly and/or to a (sheet metal) support plate of the heater assembly. Accordingly, there is a need for an improved thermostat assembly for a heater.

SUMMARY

One embodiment of the present invention provides a heater assembly, including a mounting assembly, a conducting structure, a thermostat structure, a first terminal structure and a second terminal structure, and an insulator support structure including a terminal receiving opening formed therethrough. The conducting structure is releasably and fixedly secured to the mounting assembly. The insulator support structure is also releasably and fixedly secured to the mounting assembly. The terminal receiving opening of the insulator support structure cooperates with the first terminal structure to secure the first terminal structure to the mounting assembly. The second terminal structure is releasably and fixedly secured to the mounting assembly. The thermostat structure is connected to the first terminal structure and to the second terminal structure. The first terminal structure is then connected to a power delivering structure to receive power to be used by the heater assembly, and to deliver power, through the thermostat structure, to the conducting structure. The second terminal structure is also coupled to the conducting structure.

BRIEF DESCRIPTION OF THE DRAWINGS

In the drawings, like reference numerals represent similar parts of the illustrated embodiments of the present invention throughout the several views and wherein.

DETAILED DESCRIPTION

Figure 1B:
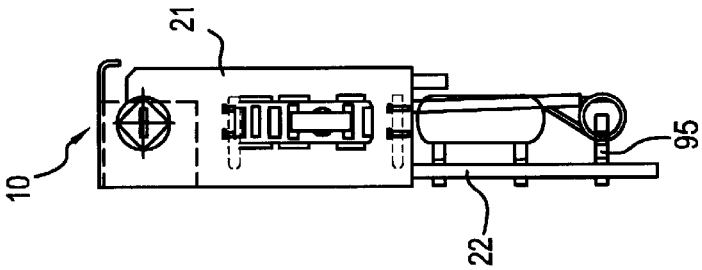
FIGS. 1A, 1B, and 1C are a side view, a front view, and a top view, respectively, of an embodiment of a heater assembly.
Figure 1A:
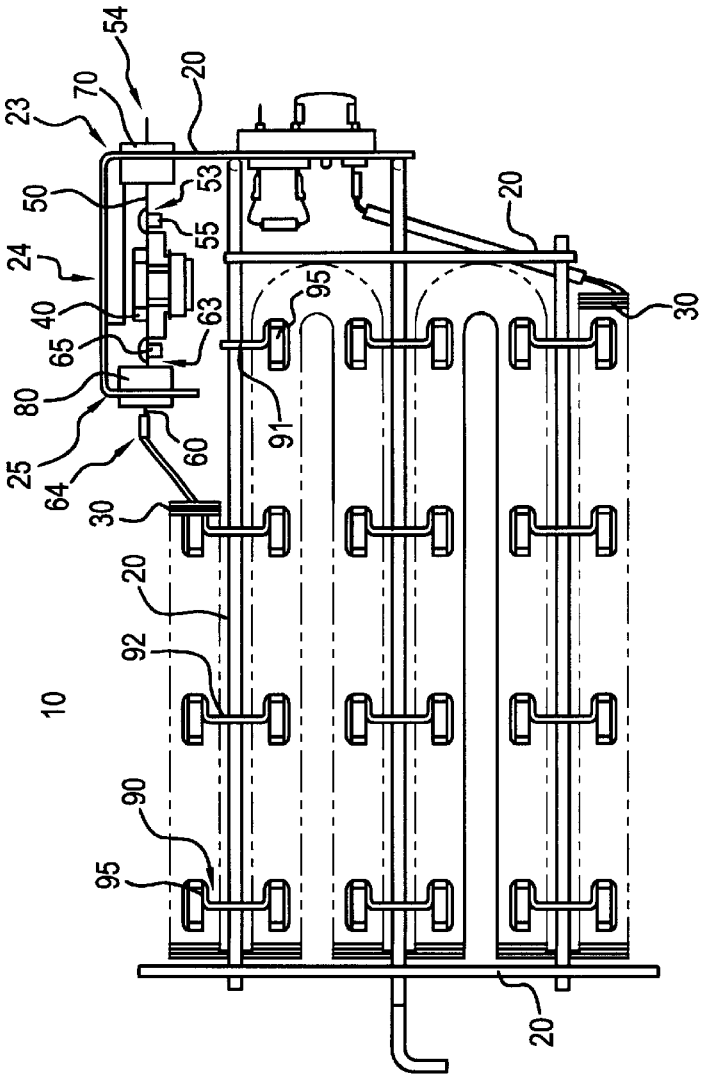
Figure 1C:
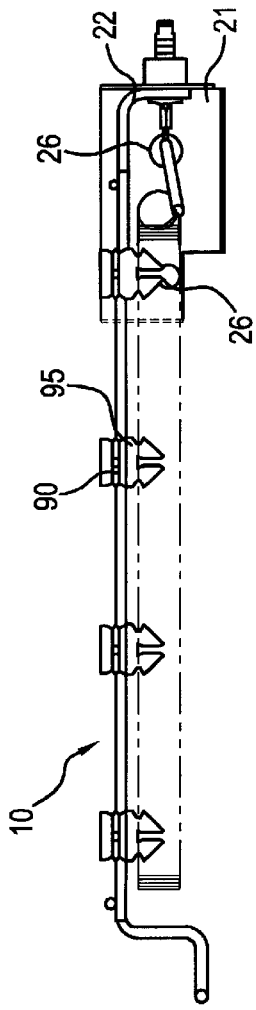

FIGS. 1A, 1B, and 1C illustrate a side view, a front view, and a top view, respectively, of an embodiment of a heater assembly 10, including a mounting assembly 20, a conducting structure 30, a thermostat structure 40, a first terminal structure 50 and a second terminal structure 60, and an insulator support structure 70 including a terminal receiving opening formed therethrough.

The mounting assembly 20 may include a mounting plate structure 21 (see FIGS. 1B and 1C). The mounting plate structure 21 may be made of sheet metal. The mounting assembly 20 may also include a mounting bar structure 22 (see FIGS. 1B and 1C). The mounting bar structure 22 may include a T-shaped cross section and/or a round-shaped cross section. The mounting plate structure 21 may be welded to the mounting bar structure 22.

The conducting structure 30 is secured (e.g., releasably and fixedly secured), for example, through a plurality of insulator support structures 95, to the mounting assembly 20 (see FIG. 1A). A plurality of securement structures 90 (e.g., clipping and/or clinching structures) may cooperate with the plurality of insulator support structures 95 and the mounting assembly 20 to releasably and fixedly secure the plurality of insulator support structures 95 to the mounting assembly 20. The plurality of securement structures 90 may be half clips 91 and/or double clips 92, for example, welded and/or clinched (not shown) to the mounting bar structure(s) 22 of the mounting assembly 20. The plurality of insulator support structures 95 may also include a (flat) bushing(s) and/or a (half or double) point suspension insulator support structure, constructed and arranged to support the conducting structure 30. The conducting structure 30 may include an electric heating coil (e.g., a coil-shaped resistive wire or a helical wound resistive wire).

The insulator support structure 70 is secured (e.g., releasably and fixedly secured) to the mounting assembly 20. The terminal receiving opening of the insulator support structure 70 cooperates with the first terminal structure 50 to secure the first terminal structure 50 to the mounting assembly 20. The terminal receiving opening of the insulator support structure 70 may extend to an outer edge portion of the insulator support structure 70 (not shown). In addition, the insulator support structure 70 may be releasably and fixedly secured to the mounting plate structure 21, where the terminal receiving opening of the insulator support structure 70 cooperates with the first terminal structure 50 to secure the first terminal structure 50 to the mounting plate structure 21. Furthermore, the insulator support structure 70 may be constructed and arranged to be releasably and fixedly secured to the mounting bar structure 22, where the terminal receiving opening of the insulator support structure 70 cooperates with the first terminal structure 70 to secure the first terminal structure 70 to the mounting bar structure 22.

The first terminal structure 50 may include a flat terminal structure (e.g., a conventional "quick-connect" termination for power connection). The first terminal structure 50 may also include one or more projections (e.g., one or more bendable tabs 51) (see FIGS. 4A and 4B), constructed and arranged to cooperate with the insulator support structure 70 to releasably and fixedly secure the first terminal structure 50 to the insulator support structure 70. For example, to releasably and fixedly secure the first terminal structure 50 to the insulator support structure 70, the first terminal structure 50 is inserted through the terminal receiving opening of the insulator support structure 70, and the projection (s) of the first terminal structure 50 is engaged (e.g., bent)

with the insulator support structure 70. At least one of the bendable tabs 51 may be aligned along a centerline of the first terminal structure 50. The size of the first terminal structure 50 may include the following approximate measurements (see FIGS. 4A and 4B): L1=1.781 in.; L2=1.594 in.; L3=0.322 in.; L4=0.163 in.; L5=0.040 in.; L6=0.65 in.; L7=0.360 in.; L=0.253 in.; L9=0.220 in.; L10=0.040 in.; L11=0.125 in.; L12=0.180 in.; L13=0.782 in.; L14=0.594 in.; L15=0.080 in.; and L16=0.032 in.

The second terminal structure 60 may include a flat terminal structure. The second terminal structure 60 is secured (e.g., releasably and fixedly secured) to the mounting assembly 20. In addition, the second terminal structure 60 may be releasably and fixedly secured to the mounting plate structure 21. Moreover, the second terminal structure 60 may be releasably and fixedly secured to the mounting bar structure 22 (not shown).

The first terminal structure 50 may include a first end portion 53 and a second end portion 54 (see FIG. 1A). The second terminal structure 60 may also include a first end portion 63 and a second end portion 64. Then, the first end portion 53 of the first terminal structure 50 may be constructed and arranged to be identical to the first end portion 63 of the second terminal structure 60. As such, the first end portion 53 of the first terminal structure 50 may be coupled to the thermostat structure 40, and the first end portion 63 of the second terminal structure 60 may also be coupled to the thermostat structure 40.

The thermostat structure 40 is then connected to both the first terminal structure 50 and to the second terminal structure 60. For example, the first end portion 53 of the first terminal structure 50 may include a fastener receiving opening 52 formed therethrough (see FIG. 4A). The thermostat structure 40 may include a corresponding threaded fastener receiving opening (not shown) formed therethrough. To couple the first terminal structure 50 to the thermostat structure 40, then the first terminal structure 50 may be placed against the thermostat structure 40 with the fastener receiving openings in alignment. A fastener 55 (e.g., threaded bolt) may be inserted through the fastener receiving opening 52 of the first terminal structure 50 and threaded onto the threaded fastener receiving opening of the thermostat structure 40 and tightened to couple the first terminal structure 50 to the thermostat structure 40 (see FIG. 1A). Similarly, the first end portion 63 of the second terminal structure 60 may be coupled to the thermostat structure 40.

In addition, the second end portion 54 of the first terminal structure 50 may be constructed and arranged not to be identical to the second end portion 64 of the second terminal structure 60. For example, the second end portion 54 of the first terminal structure 50 may be (directly) connected to a power delivering structure (not shown) to receive power to be used by the heater assembly 10, and to deliver power, through the thermostat structure 40, to the conducting structure 30. On the other hand, the second end portion 64 of the second terminal structure 60 may be (directly or indirectly) coupled to the conducting structure 30, for example, by crimping around the second end portion 64 of the second terminal structure 60 to a portion of the conducting structure 30.

The thermostat structure 40 may include an in-line thermostat structure. Also, the first terminal structure 50 may be aligned along a centerline of the thermostat structure 40; the second terminal structure 60 may also be aligned along the centerline of the thermostat structure 40 (see FIG. 1A).

The heater assembly 10 may also include a second insulator support structure 80. The second terminal structure 60 may then be releasably and fixedly secured, through the second insulator support structure 80, to the mounting assembly 20 such as, for example, the mounting plate structure 21 and/or the mounting bar structure 22. FIGS. 1A, 1B, and 1C illustrate the mounting plate structure 21 including a front portion 23, a top portion 24, and a rear portion 25, where the first insulator support structure 70 may be secured to the front portion 23 and the second insulator support structure 80 may be secured to the rear portion 25. The rear portion 25 of the mounting plate structure 21 may not be coupled (e.g., welded) to the mounting bar structure 22. That is, the rear portion 25 of the mounting plate structure 21 may be coupled to the top portion 24 of the mounting plate structure 21 (see FIG. 1A).

The top portion 24 of the mounting plate structure 21 may include receiving openings 26 formed therethrough (see FIG. 1C), aligned with the threaded fastener receiving openings (not shown) of the thermostat structure 40. As such, the fastener 55 may be inserted through one of the receiving openings 26 of the mounting plate structure 21 onto the fastener receiving opening 52 of the first terminal structure 50 (see FIG. 4A) and threaded onto one of the threaded fastener receiving openings of the thermostat structure 40 and tightened to couple the first terminal structure 50 to the thermostat structure 40. Similarly, a fastener 65 may be inserted through one of the receiving openings 26 of the mounting plate structure 21 to couple the first end portion 63 of the second terminal structure 60 to the thermostat structure 40.

The first insulator support structure 70 may be constructed and arranged to be identical to the second insulator support structure 80. In addition, the first insulator support structure 70 may be constructed and arranged not to be identical to the second insulator support structure 80. For example, each of the first insulator support structure 70 and the second insulator support structure 80 may include a bushing (e.g., a flat bushing) and/or a point suspension insulator support structure. The first insulator support structure 70 and the second insulator support structure 80 may both contain a one piece ceramic insulator structure.

The size, shape, material, and/or arrangement of the mounting assembly 20, the conducting structure 30, the thermostat structure 40, the first terminal structure 50 and the second terminal structure 60, the insulator support structure 70, the second insulator support structure 80, the securement structure(s) 90, and/or the insulator support structure(s) 95, among others, may be varied according to the preference of a user of the heater assembly 10.

Figure 2A:
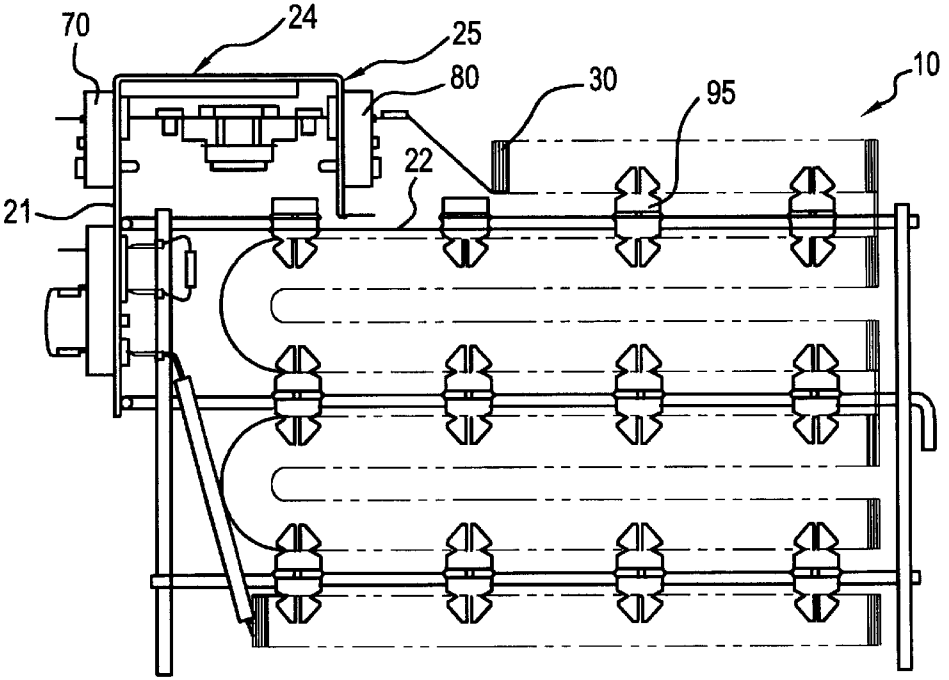
FIGS. 2A, 2B, and 2C are a side view, a front view, and a top view, respectively, of another embodiment of a heater assembly.
Figure 2C:
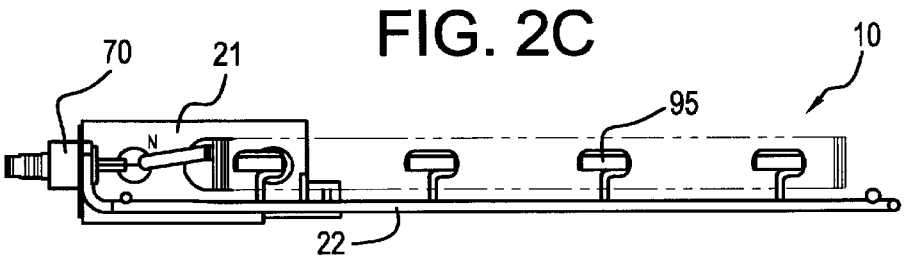
Figure 2B:
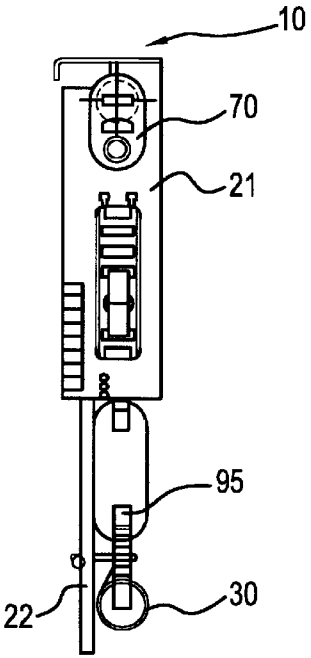

FIGS. 2A, 2B, and 2C are a side view, a front view, and a top view, respectively, of another embodiment of a heater assembly 10. Unlike the embodiment of the heater assembly 10 of FIGS. 1A, 1B, and 1C, the embodiment of the heater assembly 10 of FIGS. 2A, 2B, and 2C includes, for example, the rear portion 25 of the mounting plate structure 21 coupled (e.g., welded) to the mounting bar structure 22. That is, the rear portion 25 of the mounting plate structure 21 may be coupled to both the top portion 24 of the mounting plate structure 21 and to the rear portion 25 of the mounting plate structure 21 (see FIG. 2A). Also, the embodiment of the heater assembly 10 of FIGS. 2A, 2B, and 2C includes the insulator support structure 70 and the insulator support structure 80 both containing a two piece ceramic insulator structure. Furthermore, the embodiment of the heater assembly 10 of FIGS. 2A, 2B, and 2C includes a plurality of insulator support structures 95 containing a (double) point suspension insulator support structure, constructed and arranged to support the conducting structure 30.

An embodiment of a method for assembling the above-mentioned heater assemblies is provided. The method secures the conducting structure 30 to the mounting assembly 20, and also secures the insulator support structure 70 to the mounting assembly 20. The method secures the first terminal structure 50 and the second terminal structure 60 to the mounting assembly 20. The method then connects the thermostat structure 40 to the first terminal structure 50 and to the second terminal structure 60. The method may also secure the second insulator support structure 80 to the mounting assembly 20.

The embodiments may then include terminals, configured to conduct current to a thermostat, supported with a ceramic (s), for example, supported by a sheet metal structure such as a terminal plate. The terminals, however, may also be supported by known methods. The embodiments, for example, include a terminal connected, at one end, to an electrical lead supplying power to the heater assembly, and, at the other end, to the thermostat, where one or both ends of the terminal may be supported to the heater assembly using, for example, known methods.

Figure 4A:
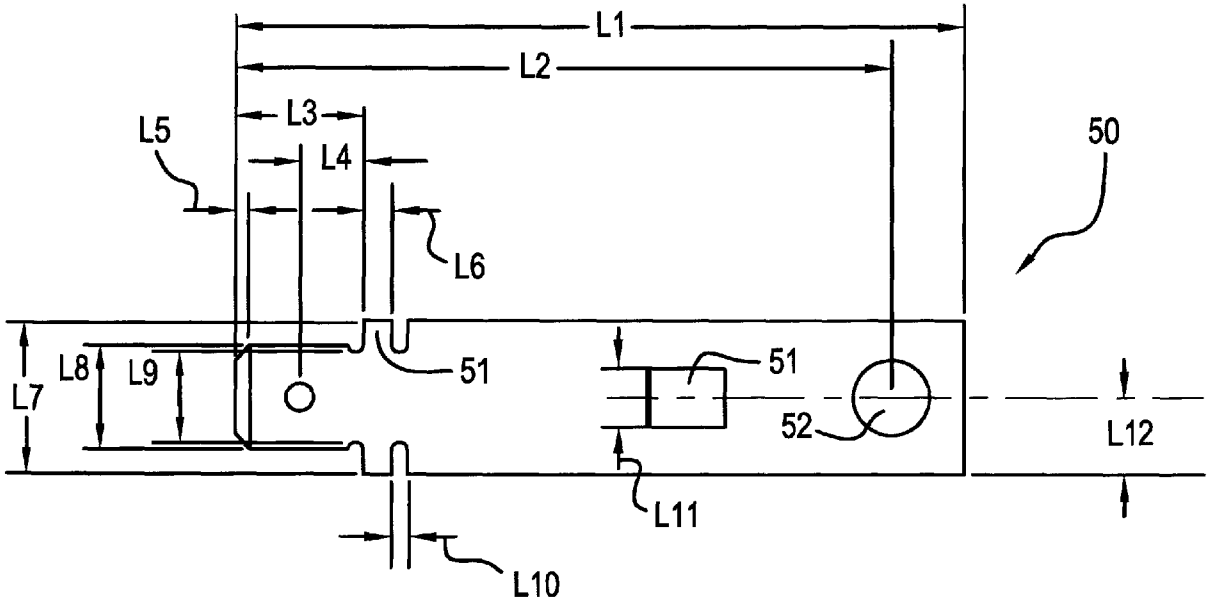
FIGS. 4A and 4B are a top view, and a side view of one embodiment of a terminal structure, in accordance with the embodiments of FIG. 1 and/or FIG. 2.
Figure 4B:
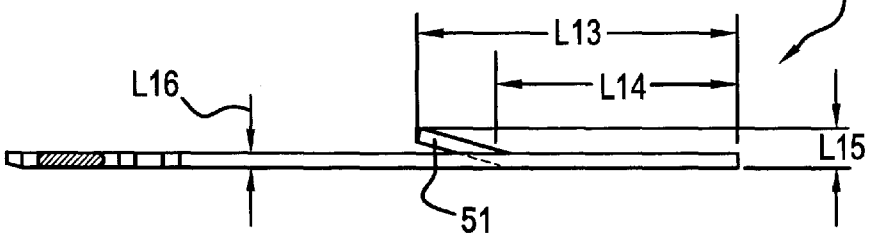

The terminal may include a standard "quick-connect" termination for power connection (see FIGS. 4A and 4B). The terminal may include two tabs, such as one on each side of the terminal adjacent to the "quick-connect" termination portion. The tabs may be bendable, and may be bent after inserting the terminal in its intended ceramic insulator(s). The bent tabs may restrain motion of the terminal in one direction, parallel to the centerline of the terminal. A third tab may restrain motion of the terminal in the opposite direction, parallel to the centerline of the terminal.

The embodiments of the heater assemblies may also include an extension to the terminal plate, for example, where a top extension portion of the terminal plate is formed at 90 degrees and a rear extension portion of terminal plate structure is formed at an additional 90 degrees (see FIGS. 1 and 2). As such, a front portion of the terminal plate is substantially perpendicular to the top extension portion and is substantially parallel with the rear extension portion. A second terminal ceramic(s) may be mounted to the rear extension portion of the terminal plate. In addition, the top extension portion of the terminal plate may include (two) holes punched therethrough to allow passage of a tool for driving (two) screws, for example, attaching the thermostat to the terminals. The embodiments, however, are not limited to such a terminal plate.

Figure 3A:
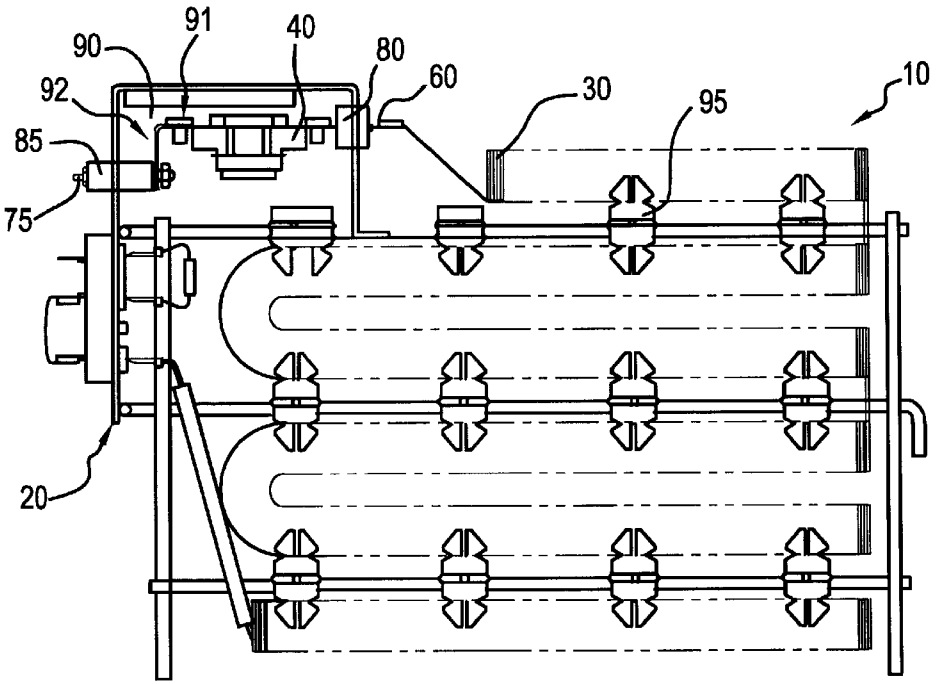
FIGS. 3A, 3B, and 3C are a side view, a front view, and a top view, respectively, of yet another embodiment of a heater assembly.
Figure 3B:
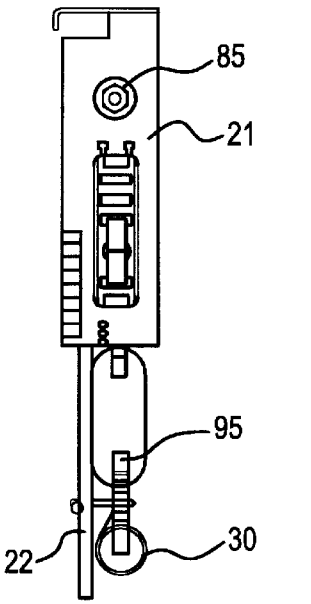
Figure 3C:
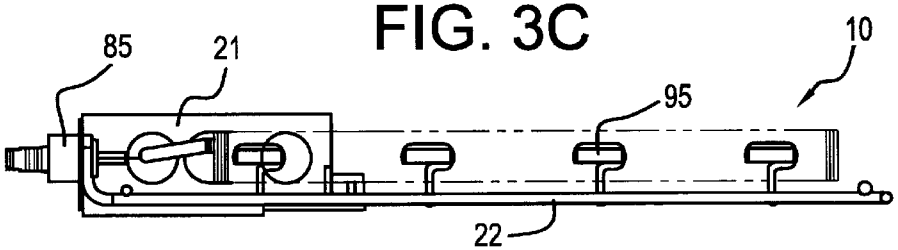

FIGS. 3A, 3B, and 3C are a side view, a front view, and a top view, respectively, of yet another embodiment of a heater assembly 10. Unlike the embodiment of the heater assembly 10 of FIGS. 2A, 2B, and 2C, the embodiment of the heater assembly 10 of FIGS. 3A, 3B, and 3C includes, for example, a power delivering structure 75. FIG. 3 illustrates an insulator support structure 85, containing a power delivering structure receiving opening formed therethrough, secured to the mounting assembly 20, similarly to the embodiment of the heater assembly 10 of FIGS. 2A, 2B, and 2C. The insulator support structure 85 may contain a two piece (interlocking) ceramic insulator structure. The power delivering structure receiving opening of the insulator support structure 85 cooperates with the power delivering structure 75 to secure the power delivering structure 75 to the mounting assembly 20. The power delivering structure may include a threaded bolt terminal structure.

Similarly to the embodiment of the heater assembly 10 of FIGS. 2A, 2B, and 2C, the thermostat structure 40 is connected to a first terminal structure 90 and to a second terminal structure 60. The first terminal structure 90 is connected to the power delivering structure 75 to receive power to be used by the heater assembly 10, and to deliver power, through the thermostat structure 40, to the conducting structure 30. The first terminal structure 90 may be L-shaped, and may include a first end portion 91 and a second end portion 92. Similarly to the embodiment of the heater assembly 10 of FIGS. 2A, 2B, and 2C, the first end portion 91 of the first terminal structure 90 may be connected to the thermostat structure 40. The second end portion 92 of the first terminal structure 90 may be connected to the threaded bolt terminal structure 75. The first terminal structure 90 may also include an outer surface having a first shaped cross section with respect to an axis of the first terminal structure 90, where the first shaped cross section may include one of round, square, rectangular and elliptical.

An embodiment of a method for assembling the above-mentioned heater assembly is also provided. The method secures the conducting structure 30 to the mounting assembly 20, and also secures the insulator support structure 85 to the mounting assembly 20. The method secures the power delivering structure 75 to the mounting assembly 20. In addition, the method secures the first terminal structure 90 and the second terminal structure 60 to the mounting assembly 20. The method connects the thermostat structure 40 to the first terminal structure 90 and to the second terminal structure 60. The method may also secure the second insulator support structure 80 to the mounting assembly 20.

As such, the embodiment may include a flat terminal containing a hole in each of its end, formed, for example, at a 90 degree angle (see FIG. 3). A threaded bolt terminal may pass through one hole of the holes of the terminal, and, in turn, may pass through holes in an insulator support structure (e.g., two interlocking ceramics). A nut may hold the threaded bolt in position. The interlocking ceramics may be affixed to a sheet metal structure (e.g., a terminal plate). A screw that engages a (in-line) thermostat terminal may pass through the other hole of the terminal. The screw may be tightened to retain the thermostat to the terminal. The other end of the thermostat may be retained as described above, and/or using known methods. The threaded bolt terminal, for example, allows for two types of power connections such as closed ring and open ring power connection terminals.

Thus, the embodiment(s) may include a terminal constructed and arranged to be connected to an in-line control, to fit a ceramic insulator(s), supported, for example, by a sheet metal structure and/or by known methods of support, and to be (directly) connected to an electrical line supplying power to the heater assembly. The embodiment(s) may also include a (flat) terminal containing a hole in each of its ends, formed at 90 degrees, and allowing (direct) attachment of an in-line control to a (threaded) terminal accepting closed ring and/or open ring power terminals. Also, the embodiment(s) may allow the in-line (thermostat) control to be supported by a terminal held in place, for example, by a sheet metal structure and/or known methods of support.

The disclosures of U.S. patent applications having Serial Nos. 09/852,947 (Patton Boggs ref. no.: 10242.181), entitled "Electric Heater Assembly with In-Line Thermostat," and 09/997,252, entitled "Improved Insulator Support Structure for a Heater Assembly" are herein incorporated by reference.

The foregoing presentation of the described embodiments is provided to enable any person skilled in the art to make or use the present invention. Various modifications to these embodiments are possible, and the generic principles presented herein may be applied to other embodiments as well. As such, the present invention is not intended to be limited to the embodiments shown above, and/or any particular configuration of structure but rather is to be accorded the widest scope consistent with the principles and novel features disclosed in any fashion herein.

What is claimed is:

1. A heater assembly comprising:

a mounting assembly;

a conducting structure;

a thermostat structure;

a first terminal structure and a second terminal structure; and an insulator support structure including a terminal receiving opening formed therethrough, wherein the conducting structure is constructed and arranged to be releasably and fixedly secured to the mounting assembly, wherein the insulator support structure is constructed and arranged to be releasably and fixedly secured to the mounting assembly, wherein the terminal receiving opening of the insulator support structure is constructed and arranged to cooperate with the first terminal structure to secure the first terminal structure to the mounting assembly, wherein the second terminal structure is constructed and arranged to be releasably and fixedly secured to the mounting assembly, wherein the thermostat structure is constructed and arranged to be connected to the first terminal structure and to the second terminal structure, wherein the first terminal structure is constructed and arranged to be connected to a power delivering structure to receive power to be used by the heater assembly, and to deliver power, through the thermostat structure, to the conducting structure, and wherein the second terminal structure is constructed and arranged to be coupled to the conducting structure.

2. The heater assembly of claim 1, wherein the mounting assembly includes a mounting plate structure.

3. The heater assembly of claim 2, wherein the mounting plate structure is made of sheet metal.

4. The heater assembly of claim 2, wherein the insulator support structure is constructed and arranged to be releasably and fixedly secured to the mounting plate structure, and wherein the terminal receiving opening of the insulator support structure is constructed and arranged to cooperate with the first terminal structure to secure the first terminal structure to the mounting plate structure.

5. The heater assembly of claim 4, wherein the first terminal structure includes a bendable tab, constructed and arranged to cooperate with the insulator support structure to releasably and fixedly secure the first terminal structure to the insulator support structure.

6. The heater assembly of claim 5, wherein the bendable tab is aligned along a centerline of the first terminal structure.

7. The heater assembly of claim 4, wherein the second terminal structure is constructed and arranged to be releasably and fixedly secured to the mounting plate structure.

8. The heater assembly of claim 7, wherein the first terminal structure is aligned along a centerline of the thermostat structure, and wherein the second terminal structure is also aligned along the centerline of the thermostat structure.

9. The heater assembly of claim 8, wherein the first terminal structure includes a flat terminal structure.

10. The heater assembly of claim 8, wherein the second terminal structure includes a flat terminal structure.

11. The heater assembly of claim 4, wherein the mounting assembly includes a mounting bar structure.

12. The heater assembly of claim 11, wherein the second terminal structure is constructed and arranged to be releasably and fixedly secured to the mounting bar structure.

13. The heater assembly of claim 11, wherein the mounting plate structure is welded to the mounting bar structure.

14. The heater assembly of claim 1, wherein the thermostat structure includes an in-line thermostat structure.

15. The heater assembly of claim 1, wherein the mounting assembly includes a mounting bar structure.

16. The heater assembly of claim 15, wherein the insulator support structure is constructed and arranged to be releasably and fixedly secured to the mounting bar structure, and wherein the terminal receiving opening of the insulator support structure is constructed and arranged to cooperate with the first terminal structure to secure the first terminal structure to the mounting bar structure.

17. The heater assembly of claim 1, wherein the first terminal structure includes a first end portion and a second end portion, wherein the second terminal structure includes a first end portion and a second end portion, wherein the first end portion of the first terminal structure is constructed and arranged to be identical to the first end portion of the second terminal structure, and wherein the second end portion of the first terminal structure is constructed and arranged not to be identical to the second end portion of the second terminal structure.

18. The heater assembly of claim 1, further comprising a second insulator support structure, wherein the second terminal structure is constructed and arranged to be releasably and fixedly secured, through the second insulator support structure, to the mounting assembly.

19. The heater assembly of claim 18, wherein the first mentioned insulator support structure is constructed and arranged to be identical to the second insulator support structure.

20. The heater assembly of claim 18, wherein the first mentioned insulator support structure is constructed and arranged not to be identical to the second insulator support structure.

21. A heater assembly comprising:

a mounting assembly;

a conducting structure;

a thermostat structure;

a first terminal structure and a second terminal structure;

a power delivering structure; and an insulator support structure including a power delivering structure receiving opening formed therethrough, wherein the conducting structure is constructed and arranged to be releasably and fixedly secured to the mounting assembly, wherein the insulator support structure is constructed and arranged to be secured to the mounting assembly, wherein the power delivering structure receiving opening of the insulator support structure is constructed and arranged to cooperate with the power delivering structure to secure the power delivering structure to the mounting assembly, wherein the thermostat structure is constructed and arranged to be connected to the first terminal structure and to the second terminal structure, wherein the first terminal structure is constructed and arranged to be connected to the power delivering structure to receive power to be used by the heater assembly, and to deliver power, through the thermostat structure, to the conducting structure, and wherein the second terminal structure is constructed and arranged to be releasably and fixedly secured to the mounting assembly, and to be coupled to the conducting structure.

22. The heater assembly of claim 21, wherein the power delivering structure includes a threaded bolt terminal structure.

23. The heater assembly of claim 22, wherein the first terminal structure is constructed and arranged to be L-shaped, and to include a first end portion and a second end portion, wherein the first end portion of the first terminal structure is constructed and arranged to be connected to the thermostat structure, and wherein the second end portion of the first terminal structure is constructed and arranged to be connected to the threaded bolt terminal structure.

24. The heater assembly of claim 23, wherein the second terminal structure includes a first end portion and a second end portion, wherein the first end portion of the second terminal structure is constructed and arranged to be identical to the first end portion of the first terminal structure, and wherein the second end portion of the second terminal structure is constructed and arranged not to be identical to the second end portion of the first terminal structure.

25. The heater assembly of claim 21, wherein the mounting assembly includes a mounting plate structure.

26. The heater assembly of claim 25, wherein the mounting plate structure is made of sheet metal.

27. The heater assembly of claim 25, wherein the insulator support structure is constructed and arranged to be releasably and fixedly secured to the mounting plate structure, and wherein the power delivering structure receiving opening of the insulator support structure is constructed and arranged to cooperate with the power delivering structure to secure the power delivering structure to the mounting plate structure.

28. The heater assembly of claim 27, wherein the power delivering structure includes a threaded bolt terminal structure.

29. The heater assembly of claim 28, wherein the first terminal structure is constructed and arranged to be L-shaped, and to include a first end portion and a second end portion, wherein the first end portion of the first terminal structure is constructed and arranged to be connected to the thermostat structure, and wherein the second end portion of the first terminal structure is constructed and arranged to be connected to the threaded bolt terminal structure.

30. The heater assembly of claim 29, wherein the second terminal structure is constructed and arranged to be releasably and fixedly secured to the mounting plate structure.

31. The heater assembly of claim 29, wherein the mounting assembly includes a mounting bar structure.

32. The heater assembly of claim 31, wherein the second terminal structure is constructed and arranged to be releasably and fixedly secured to the mounting bar structure.

33. The heater assembly of claim 31, wherein the mounting plate structure is welded to the mounting bar structure.

34. The heater assembly of claim 21, wherein the thermostat structure includes an in-line thermostat structure.

35. The heater assembly of claim 21, further comprising a second insulator support structure, wherein the second terminal structure is constructed and arranged to be releasably and fixedly secured, through the second insulator support structure, to the mounting assembly.

36. The heater assembly of claim 35, wherein the second insulator support structure is constructed and arranged to be identical to the first mentioned insulator support structure.

37. The heater assembly of claim 35, wherein the second insulator support structure is constructed and arranged not to be identical to the first mentioned insulator support structure.

38. The heater assembly of claim 21, wherein the first terminal structure includes an outer surface having a first shaped cross section with respect to an axis of the first terminal structure, and wherein the first shaped cross section includes one of round, square, rectangular and elliptical.

39. A method for assembling a heater assembly, comprising:

securing a conducting structure to a mounting assembly;

securing an insulator support structure, including a terminal receiving opening formed therethrough, to the mounting assembly;

securing a first terminal structure and a second terminal structure to the mounting assembly; and connecting a thermostat structure to the first terminal structure and to the second terminal structure, wherein the conducting structure is constructed and arranged to be releasably and fixedly secured to the mounting assembly, wherein the insulator support structure is constructed and arranged to be releasably and fixedly secured to the mounting assembly, wherein the terminal receiving opening of the insulator support structure is constructed and arranged to cooperate with the first terminal structure to secure the first terminal structure to the mounting assembly, wherein the second terminal structure is constructed and arranged to be releasably and fixedly secured to the mounting assembly, wherein the first terminal structure is constructed and arranged to be connected to a power delivering structure to receive power to be used by the heater assembly, and to deliver power, through the thermostat structure, to the conducting structure, and wherein the second terminal structure is constructed and arranged to be coupled to the conducting structure.

40. The method of claim 39, wherein the mounting assembly includes a mounting plate structure.

41. The method of claim 40, wherein the insulator support structure is constructed and arranged to be releasably and fixedly secured to the mounting plate structure, and wherein the terminal receiving opening of the insulator support structure is constructed and arranged to cooperate with the first terminal structure to secure the first terminal structure to the mounting plate structure.

42. The method of claim 41, wherein the first terminal structure includes a bendable tab, constructed and arranged to cooperate with the insulator support structure to releasably and fixedly secure the first terminal structure to the insulator support structure.

43. The method of claim 42, wherein the bendable tab is aligned along a centerline of the first terminal structure.

44. The method of claim 41, wherein the second terminal structure is constructed and arranged to be releasably and fixedly secured to the mounting plate structure.

45. The method of claim 41, wherein the mounting assembly includes a mounting bar structure.

46. The method of claim 45, wherein the second terminal structure is constructed and arranged to be releasably and fixedly secured to the mounting bar structure.

47. The method of claim 39, wherein the mounting assembly includes a mounting bar structure.

48. The method of claim 47, wherein the insulator support structure is constructed and arranged to be releasably and fixedly secured to the mounting bar structure, and wherein the terminal receiving opening of the insulator support structure is constructed and arranged to cooperate with the first terminal structure to secure the first terminal structure to the mounting bar structure.

49. The method of claim 39, wherein the first terminal structure includes a first end portion and a second end portion, wherein the second terminal structure includes a first end portion and a second end portion, wherein the first end portion of the first terminal structure is constructed and arranged to be identical to the first end portion of the second terminal structure, and wherein the second end portion of the first terminal structure is constructed and arranged not to be identical to the second end portion of the second terminal structure.

50. The method of claim 39, further comprising securing a second insulator support structure to the mounting assembly, wherein the second terminal structure is constructed and arranged to be releasably and fixedly secured, through the second insulator support structure, to the mounting assembly.

51. The method of claim 50, wherein the first mentioned insulator support structure is constructed and arranged to be identical to the second insulator support structure.

52. The method of claim 50, wherein the first mentioned insulator support structure is constructed and arranged not to be identical to the second insulator support structure.

53. A method for assembling a heater assembly, comprising:

securing a conducting structure to a mounting assembly;

securing an insulator support structure, including a power delivering structure receiving opening formed therethrough, to the mounting assembly;

securing a power delivering structure to the mounting assembly;

securing a first terminal structure and a second terminal structure to the mounting assembly; and connecting a thermostat structure to the first terminal structure and to the second terminal structure, wherein the conducting structure is constructed and arranged to be releasably and fixedly secured to the mounting assembly, wherein the insulator support structure is constructed and arranged to be secured to the mounting assembly, wherein the power delivering structure receiving opening of the insulator support structure is constructed and arranged to cooperate with the power delivering structure to secure the power delivering structure to the mounting assembly, wherein the thermostat structure is constructed and arranged to be connected to the first terminal structure and to the second terminal structure, wherein the first terminal structure is constructed and arranged to be connected to the power delivering structure to receive power to be used by the heater assembly, and to deliver power, through the thermostat structure, to the conducting structure, and wherein the second terminal structure is constructed and arranged to be releasably and fixedly secured to the mounting assembly, and to be coupled to the conducting structure.

54. The method of claim 53, wherein the power delivering structure includes a threaded bolt terminal structure.

55. The method of claim 54, wherein the first terminal structure is constructed and arranged to be L-shaped, and to include a first end portion and a second end portion, wherein the first end portion of the first terminal structure is constructed and arranged to be connected to the thermostat structure, and wherein the second end portion of the first terminal structure is constructed and arranged to be connected to the threaded bolt terminal structure.

56. The method of claim 55, wherein the second terminal structure includes a first end portion and a second end portion, wherein the first end portion of the second terminal structure is constructed and arranged to be identical to the first end portion of the first terminal structure, and wherein the second end portion of the second terminal structure is constructed and arranged not to be identical to the second end portion of the first terminal structure.

57. The method of claim 53, wherein the mounting assembly includes at least one of a mounting plate structure and a mounting bar structure.

58. The method of claim 57, wherein the insulator support structure is constructed and arranged to be releasably and fixedly secured to the at least one of the mounting plate structure and the mounting bar structure, and wherein the power delivering structure receiving opening of the insulator support structure is constructed and arranged to cooperate with the power delivering structure to secure the power delivering structure to the at least one of the mounting plate structure and the mounting bar structure.

59. The method of claim 58, wherein the second terminal structure is constructed and arranged to be releasably and fixedly secured to the at least one of the mounting plate structure and the mounting bar structure.

60. The method of claim 53, further comprising securing a second insulator support structure to the mounting assembly, wherein the second terminal structure is constructed and arranged to be releasably and fixedly secured, through the second insulator support structure, to the mounting assembly.

61. The method of claim 60, wherein the second insulator support structure is constructed and arranged to be identical to the first mentioned insulator support structure.

62. The method of claim 60, wherein the second insulator support structure is constructed and arranged not to be identical to the first mentioned insulator support structure.

* * * * *